US006457778B1

(12) United States Patent
Chung et al.

(10) Patent No.: US 6,457,778 B1
(45) Date of Patent: Oct. 1, 2002

(54) ELECTRO-POWER IMPACT CELL FOR PLASMA BLASTING

(75) Inventors: Kie Hyung Chung, Pyongtaek; Kang Ok Lee, Seoul; Hyeok Jung Kwon, Inchon; Chul Yeong Kim, Kunpo; Kyoung Jae Chung, Seoul, all of (KR)

(73) Assignee: Korea Accelerator and Plasma Research Association, Seoul (KR)

( * ) Notice: Subject to any disclaimer, the term of this patent is extended or adjusted under 35 U.S.C. 154(b) by 0 days.

(21) Appl. No.: 09/516,899

(22) Filed: Mar. 1, 2000

(30) Foreign Application Priority Data

Mar. 2, 1999 (KR) ..... 99-6821

(51) Int. Cl.[7] ..... E21C 37/18; E21C 37/14
(52) U.S. Cl. ..... 299/14; 175/16
(58) Field of Search ..... 299/14, 16; 175/16; 166/63, 299

(56) References Cited

U.S. PATENT DOCUMENTS 4,479,680 A * 10/1984 Wesley et al. ..... 299/14
4,741,405 A 5/1988 Moeny et al. ..... 175/16
5,106,164 A * 4/1992 Kitzinger et al. ..... 299/14
5,425,570 A * 6/1995 Wilkinson ..... 299/14
5,482,357 A * 1/1996 Wint et al. ..... 299/14
5,773,750 A 6/1998 Jae et al. ..... 102/302
6,145,934 A * 11/2000 Arai et al. ..... 299/21

FOREIGN PATENT DOCUMENTS

EP 0453076 A1 5/1991 ..... E21C/37/18
JP 7-224586 * 8/1995
JP 7-233694 * 9/1995
JP 09-029733 4/1997 ..... B28D/1/00
JP 11-236793 * 9/1999

* cited by examiner

*Primary Examiner*—Heather Shackelford
*Assistant Examiner*—John Kreck
(74) *Attorney, Agent, or Firm*—Lee & Hong

(57) ABSTRACT

An electro-power impact cell used in blasting works includes a first electrode to which a high voltage is applied, the first electrode having a plurality of conductive piece between which nonconductive pieces are disposed so that when the high voltage is applied to the first electrode, arc occur at the nonconductive piece; a second electrode spaced away from the first electrode; and a closed-cartridge enclosing the first and second electrodes while containing electrolyte.

6 Claims, 5 Drawing Sheets

ELECTRO-POWER IMPACT CELL FOR PLASMA BLASTING

This application claims the benefit of Korean Patent Application No. 1999-6821, filed on Mar. 2, 1999, which is hereby incorporated by reference.

BACKGROUND OF THE INVENTION

1) Field of the Invention

The present invention relates to a plasma blasting system, more particularly, to an electrode assembly of a plasma blasting system.

2) Description of Related Arts

Generally, in blasting for construction work, public works, or excavating works, explosives (such as dynamite), machinery (such as hydraulic jacks and breaker), or chemicals (expandable demolition material) have been used.

However, when explosives, such as dynamite, are used for blasting, the blasting is very difficult to perform in crowded or urban areas (i.e. downtown) and is restricted in time and working area, since vibration and noises are very high. Broken pieces are scattered and a large quantity of dust is generated.

Accordingly, when blasting is performed using explosives such as dynamite, anti-pollution facilities and safety appliances must be installed, thereby increasing cost. Still, in spite of these safety precautions, it is very dangerous.

Recently, a plasma blasting method using electric energy has been disclosed. This method involves instantly discharging very large electric energy into electrodes in a rock thereby producing an explosion.

FIGS. 1 and 2 show an electrode assembly of a conventional plasma blasting system.

As shown in FIG. 1, the plasma blasting system has an electrolyte 80 and a coaxial cable of an electrode assembly comprising an inner electrode 10, outer electrodes 12 and 13 and an insulating member 11 therebetween, which is disclosed in U.S. Pat. No. 5,773,750.

FIG. 2 shows another electrode assembly according to prior art, which has two parallel electrodes 21 that are soaked or inserted into the electrolyte 80 in an electrolytic cell 22.

High current is introduced from a capacitor bank or power supply into the electrode assembly 21 and is discharged into the electrolyte 80 to increase blasting force capable of generating an instantaneous reaction energy.

At this point, the application of the high electrical energy to the electrolyte 80 must occur at a rate sufficient to cause sudden reaction energy production. The sudden reaction energy produced must be sufficient in strength to cause blasting.

In the conventional plasma blasting system or pulse power system, however, when the high current flows through the electrode assembly 21 and is discharged into the electrolyte 80, reaction occurs locally. And most of the electrolytes 80 react by the generated chemical energy induced by the locally discharge. And the rest of the electrolytes 80 even do not react.

Therefore, this system is limited in blasting force by the supply of electric energy, and it is difficult to generate a short pulse pressure essential to a plasma blasting system. Further, this system is not efficient to use in construction work, public works and excavating works due to the large size of the machine required. Particularly, since the amount of electrolyte reacting during work is so limited, the efficiency of the system is deteriorated.

In addition, since a connecting wire and the electrolytic cell 22 are integrally formed, the connecting wire must be disused after the blasting work.

SUMMARY OF THE INVENTION

Therefore, the present invention has been made in an effort to solve the above-described problems.

It is an object of the present invention to provide an electro-power impact cell with improved blasting efficiency.

It is still another object of the present invention to provide an electro-power impact cell with a removable transmission wire.

To achieve the above objects, in its one aspect, the present invention provides an electro-power impact cell including, a first electrode to which a first voltage is applied; a second electrode to which an opposite voltage to the first voltage is applied; an eletrolyte enclosing the first and second electrodes; and wherein there is at least one gap between the first and the second electrods and the at least one gap is supported by a nonconductive piece.

To achieve the above objects, in its another aspect, an electro-power impact cell includes a first electrode to which a high voltage is applied, the first electrode having a plurality of conductive piece between which nonconductive pieces are disposed so that when the high voltage is applied to the first electrode, arc occur at the nonconductive piece; a second electrode spaced away from the first electrode; and a closed-cartridge enclosing the first and second electrodes while containing electrolyte.

To achieve the above objects, in its another aspect, the present invention provides a plasma blasting system, including a electro-power impact cell having first and second electrodes and an electrolyte; a power supply for generating electric energy; a transmission wire for transmitting electric energy to the electro-power impact cell; and a connector for removably connecting the transmission wire to the electro-power impact cell.

The cartridge comprises a cylindrical conductive part integrated with the second electrode and having an open end, and an insulating part for insulating the second electrode from the first electrode, the insulating part being close-tightly fitted on the open end of the conductive part.

The first and second electrodes are inserted in the cartridge in a state where the first and second electrodes are facing each other.

The electro-power impact cell further includes a connector for connecting the first and second electrodes to an external transmission wire and a jack for removably mounting the connector to the first and second electrodes.

BRIEF DESCRIPTION OF THE DRAWINGS

The accompanying drawings, which are incorporated in and constitute a part of the specification, illustrate an embodiment of the invention, and, together with the description, serve to explain the principle of the invention.

DETAILED DESCRIPTION OF THE PREFERRED EMBODIMENTS

Preferred embodiments of the present invention will now be described in detail with reference to the accompanying drawings.

Figure 1:
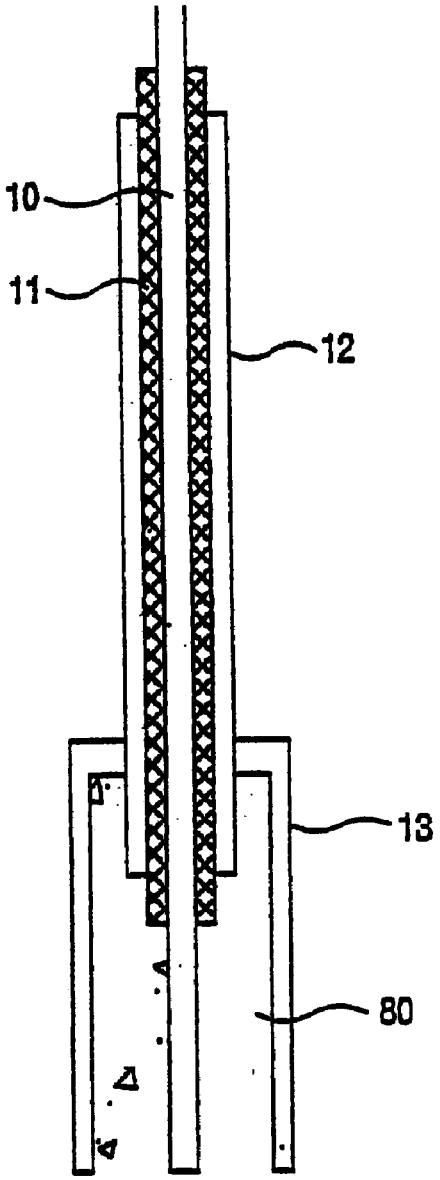
(Prior Art) FIG. 1
FIG. 1 is a schematic sectional view illustrating an electrode assembly of a conventional plasma blasting system.
Figure 2:
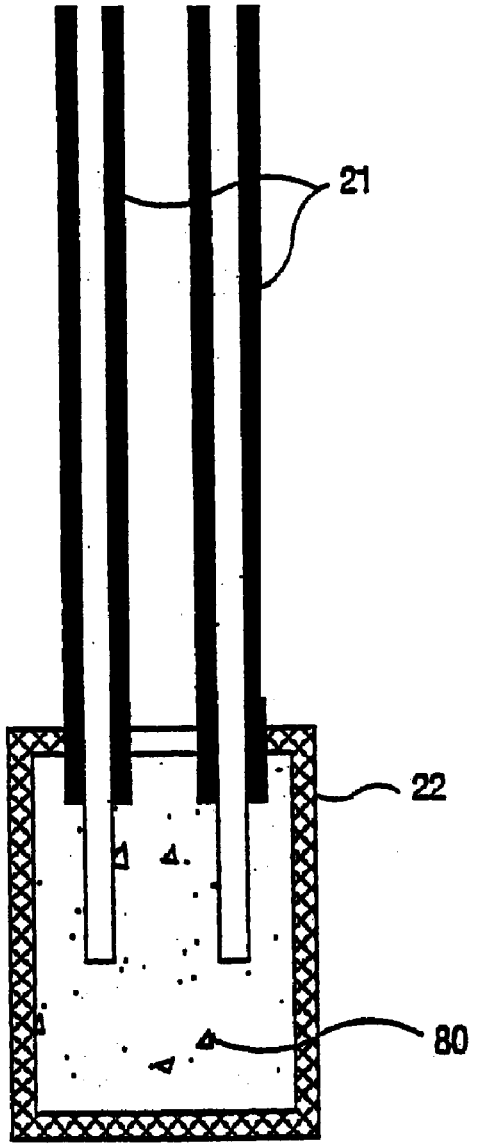
(Prior Art) FIG. 2
FIG. 2 is a schematic sectional view illustrating another electrode assembly of a conventional plasma blasting system.
Figure 3:
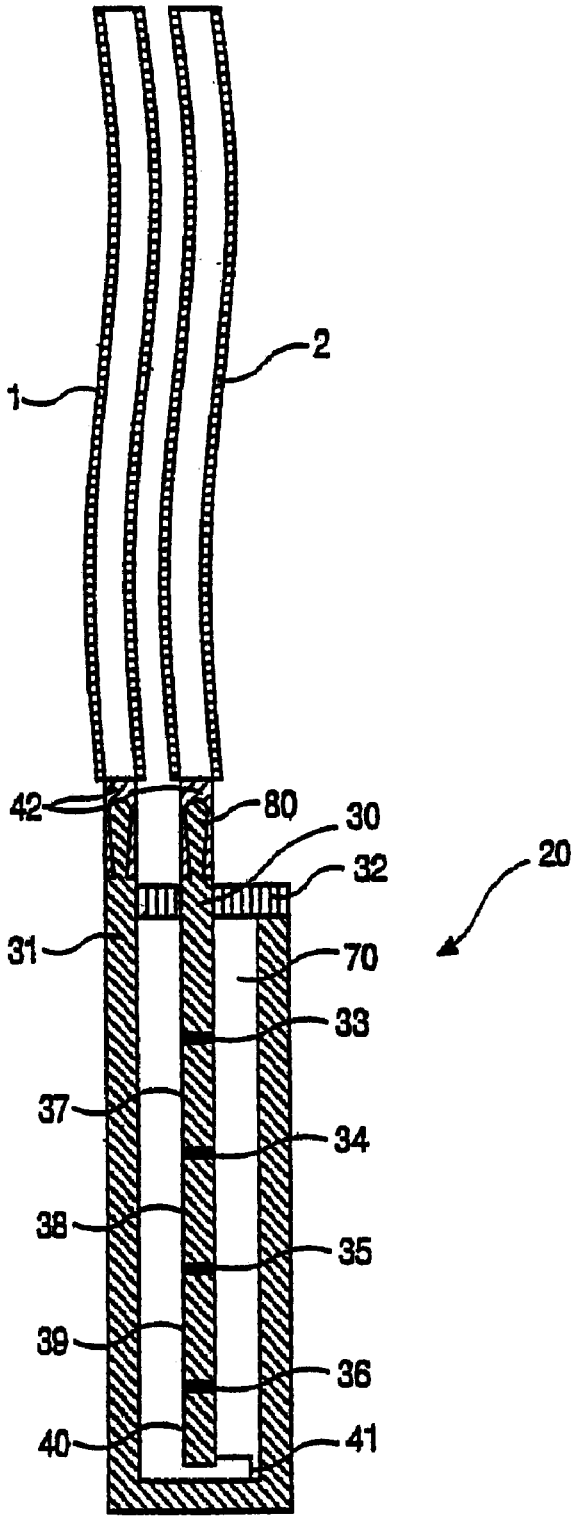
FIG. 3 is a schematic sectional view of an electro-power impact cell according to a preferred embodiment of the present invention.

As shown in FIG. 3, an electro-power impact cell includes an electrolytic cell or cartridge 20 connected to both outer and inner conductors 31 and 30. The outer conductor 31 is connected to a first wire 1, and the inner conductor 31 is connected to a second wire 2. The outer conductor 31 is hollow cylindrical shaped and has an opening on its one end. The inner conductor 30 is disposed within the cylindrical outer conductor 31, extending outwardly through the opening of the outer conductor 31 to be connected to the second wire 2.

An insulating plate 32 is located to block the opening of the outer conductor 31. Electrolyte 70 is accommodated in the closed space of the cylindrical outer conductor 31.

The inner conductor 30 includes first to fourth conductors 37, 38, 39 and 40 and first to fourth nonconductors 33, 34, 35 and 36, which are made of insulating material such as MC-nylon or wood. Each of the nonconductors 33, 34, 35 and 36 is located at a corresponding gap between adjacent conductors 37, 38, 39, and 40. Each height of the nonconductors 33, 34, 35 and 36 is several millimeters. The first to fourth conductors 37, 38, 39 and 40 and the nonconductors are attached to each other using a suitable method such as a screw-tightening or a bonding method.

When a switch to apply high voltages is turned on, high current is induced to the inner conductor 30 through the second wire 2 and to the first nonconductor 33, where it is discharged. Then it is consecutively induced to the second to fourth nonconductors 34, 35 and 36 only to be discharged. At this point, since a time delay during the discharge at each gap is very short, it seems that the arc occurs simultaneously at each gap.

Further, an inductor 41 may be provided between the fourth conductor 40 and the outer conductor 31 for a uniform discharge.

Thus, according to the invention, since the arc occurring at the gaps can make ignition occur at a plurality of points of the electrolyte 70, an impact force is increased as compared with a conventional blasting system in which the ignition occurs only at a point of the electrolyte 70. In addition, attained is the short impact time independent of the length of the inner electrode.

Further, the electrolytic cell 20 is designed to be connected to the first and second wires 1 and 2 by a connector 42 so that the electrolytic cell 20 can be separated from the first and second wires 1 and 2. The inner and outer conductors or electrodes 30 and 31 also can be separated from the connector 42 using a jack 80.

Figure 4A:
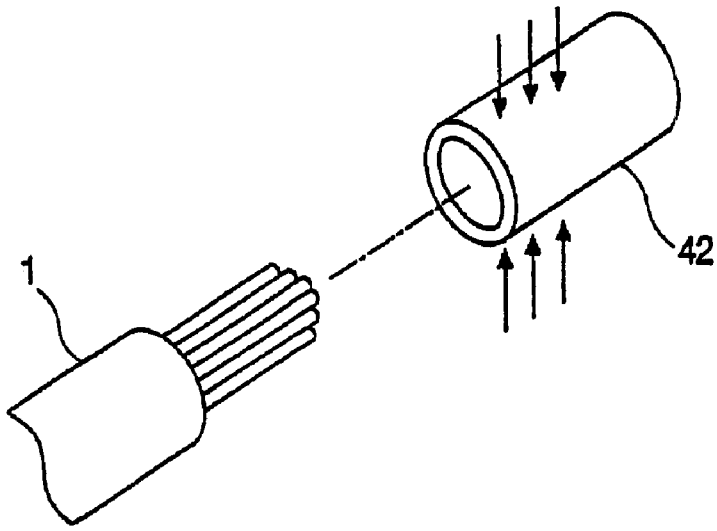
FIG. 4*a* is a schematic exploded view of a coupling structure of a connector and a transmission wire according to the present invention.
Figure 4B:
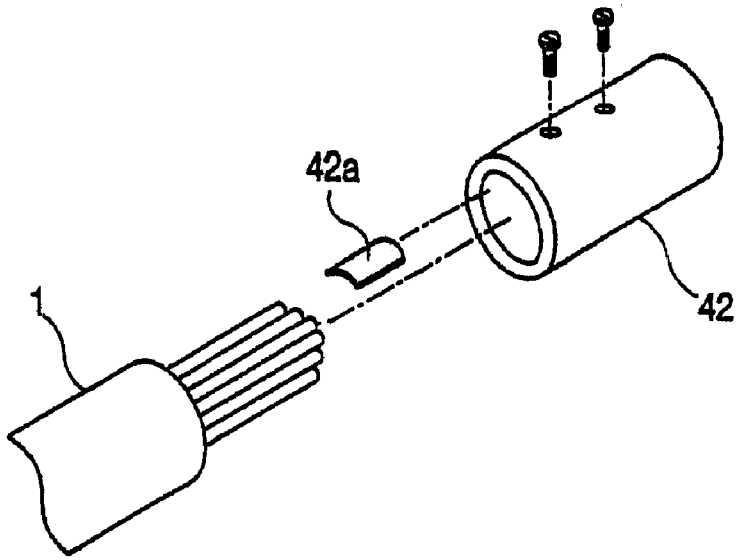
FIG. 4*b* is a schematic exploded view of another coupling structure of a connector and a transmission wire according to the present invention.

FIGS. 4*a* and 4*b* show various examples of a coupling structure of connecting the wire to the connector.

As shown in FIG. 4*a*, the first wire 1 may be forcedly fitted into the connector 42 such that after connecting the wire 1 to the connector 42 the outer surface of the connector 42 is pressed to fix the wire 1.

As shown in FIG. 4*b*, a depressing plate 42*a* can be disposed between the wire 1 and the connector 42 so that the wire can be tightened into the connector 42 by screws.

Accordingly, after the blasting work is finished, the first and second wires 1 and 2 and the connector 42 can be re-used by separating them from the electrolytic cell 20.

Figure 5:
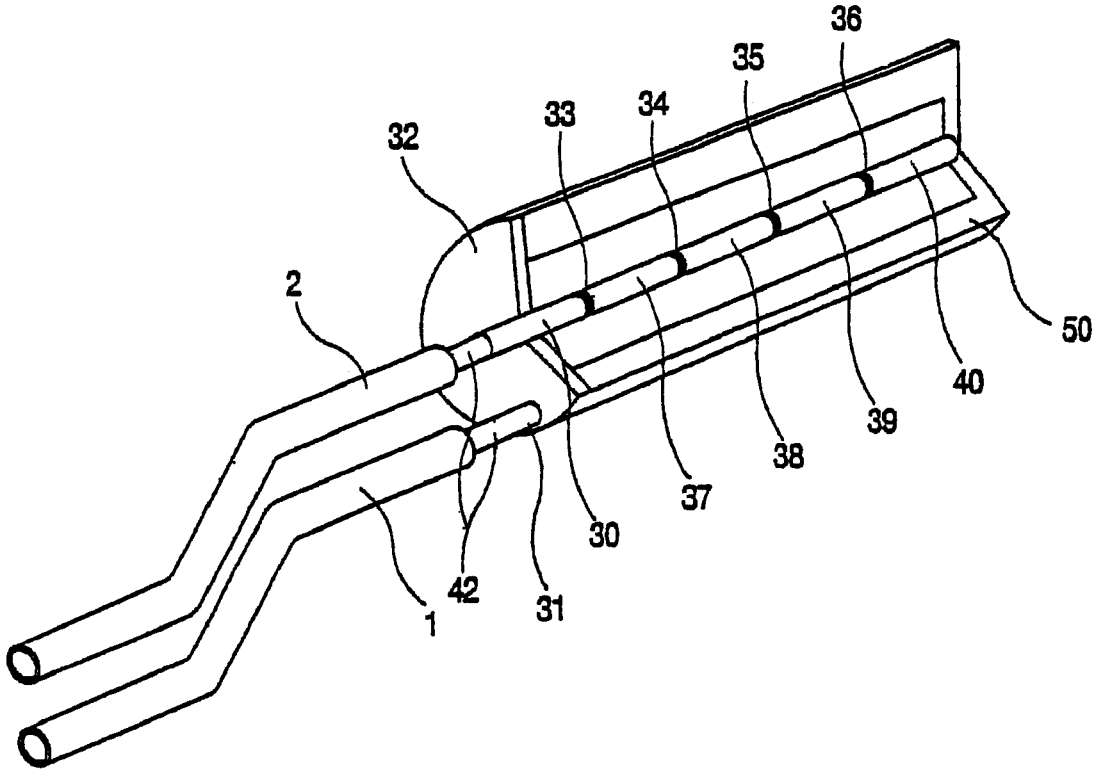
FIG. 5 is a partially broken perspective view of an electro-power impact cell depicted in FIG. 3.

The shape of the electro-power impact cell can be varied according to conditions of a blasting place. FIG. 5 is a partially broken perspective view of the electro-power impact cell depicted in FIG. 3. The electro-power impact cell shown is generally used in general blasting work.

Figure 6:
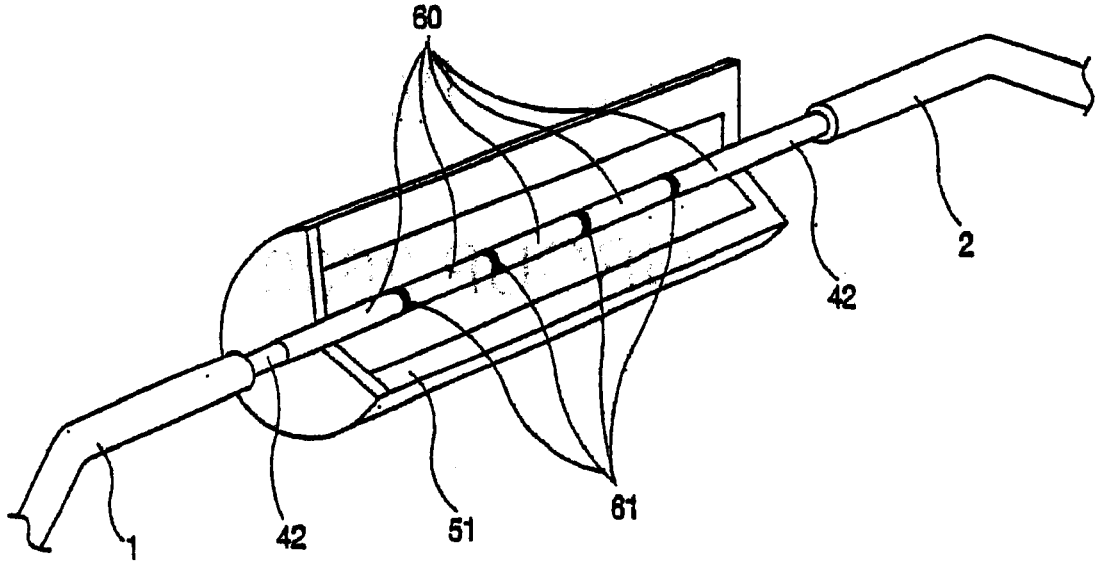
FIG. 6 is a partially broken perspective view of an electro-power impact cell according to another embodiment of the present invention.

FIG. 6 shows an electro-power impact cell according to another embodiment of the present invention.

First and second wires 1 and 2 facing each other are coupled to a electrolytic cell 51 of nonconductive material. High current flows along a central electrode 60 which is connected to the first and second wires 1 and 2. The central electrode 60 is shaped one line, but has several gaps 61 spaced regularly.

The electro-power impact cell shown in FIG. 6 is effective when used in blasting work of a penetrated rock.

In the above described electro-power impact cell, since the central electrode 60 is divided into a plurality of pieces, ignition occurs at a plurality of portions of electrolyte, increasing impact force. In addition, since impact time is independent of the length of the central electrode 60, the shape of the cell can be varied in accordance with blasting conditions. Furthermore, since the electro-power impact cell is designed so that the electrolytic cell 51 can be separated from wires by using the connectors 42, costs can be reduced.

As described until here, the electro-power impact cell according to the present invention can increase blasting force by simultaneous ignition at a plurality of points of the electrolyte. Cost can be reduced due to the removable connector for connecting the wire to the electrode.

Other embodiments of the invention will be apparent to the skilled in the art from consideration of the specification and practice of the invention disclosed herein. That is, without cartridge enclosing the two electrodes, the electro-power impact cell can work if it is enclosed by soil or sand after depositing the cell and the electrolyte therein.

Figure 7:
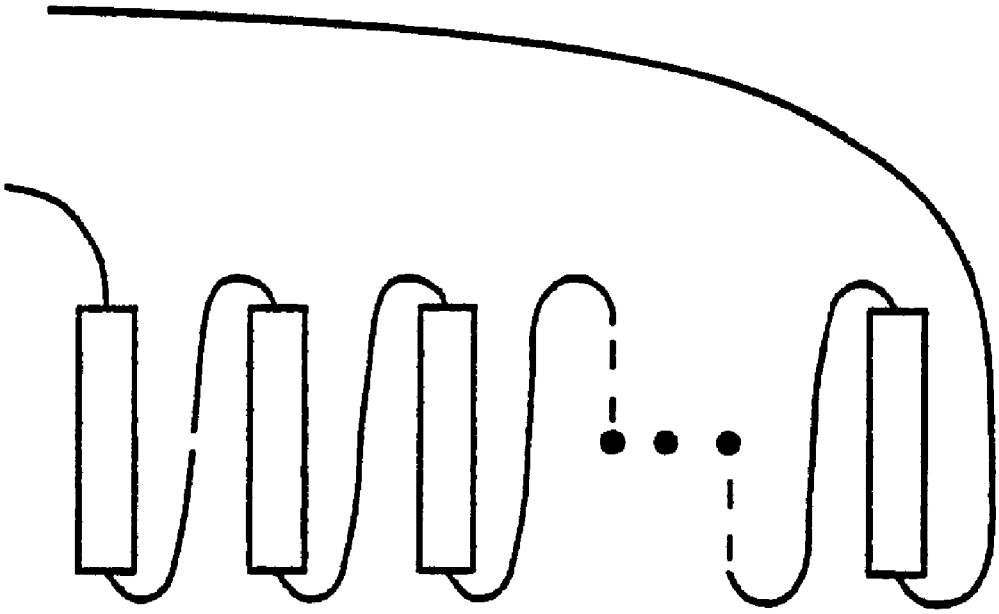
FIG. 7 is a schematic view of using pluralities of the electro-power impact cells of the invention combined linearly.

Further, FIG. 7 shows that pluralities of the electro-power impact cells of the invention can be used if it is combined linearly.

First and second wires 1 and 2 are coupled to another wires of electro-power impact cells.

The electro-power impact cells shown in FIG. 7 is used in simultaneous blasting for more effective blasting.

It is intended that the specification and examples be considered as exemplary only, with the true scope and spirit of the invention being indicated by the following claims.

What is claimed is:

1. An electro-power impact cell comprising:

a first electrode to which a first voltage is applied;

a second electrode to which an opposite voltage to the first voltage is applied, the second electrode having a shape of a hollow cylinder;

at least one conductor linearly disposed at an end of the first electrode;

a nonconductive piece coupled to the at least one conductor and arranged between the at least one conductor and the first electrode; and an electrolyte disposed between the at least one conductor and the second electrode, wherein the first electrode, the at least one conductor and the nonconductive piece are disposed along an axis of the second electrode.

2. The electro-power impact cell of claim 1, wherein the electrolyte is enclosed by a cartridge.

3. The electro-power impact cell of claim 1, further comprising a connector to be connected to an external transmission wire and a jack for removably mounting the first and second electrodes to the connector.

4. A cell assembly for plasma blasting, the cell assembly comprising:

a first electrode;

a second electrode in the shape of a hollow cylinder;

a nonconductive piece connected to the first electrode, wherein the first electrode and the nonconductive piece are disposed along an axis of the second electrode; and a conductor piece extending from the first electrode separated by the nonconductive piece disposed therebetween, wherein when the first electrode and the second electrodes are energized an arc is create near the nonconductive piece.

5. The cell assembly of claim 4, further comprising an electrolyte disposed between the conductor piece and the second electrode.

6. The cell assembly of claim 5, wherein the electrolyte is enclosed in a cartridge.

* * * * *